United States Patent [19]

Rayburn

[11] 3,984,797

[45] Oct. 5, 1976

[54] SWITCH OPERATOR

[75] Inventor: Donald L. Rayburn, Asheville, N.C.

[73] Assignee: Square D Company, Park Ridge, Ill.

[22] Filed: Mar. 20, 1975

[21] Appl. No.: 560,198

[52] U.S. Cl. ..... 335/306; 200/67 F; 200/314; 335/207

[51] Int. Cl.[2] ..... H01F 7/02; H01H 3/20

[58] Field of Search ..... 200/313, 314, 318, 319, 200/327, 328, 329, 340, 159 R, 159 B, 67 F; 335/205, 206, 207, 306

[56] References Cited

UNITED STATES PATENTS

| | | | |
|---|---|---|---|
| 3,175,060 | 3/1965 | Crissinger et al. | 335/205 |
| 3,283,274 | 11/1966 | DeFalco | 335/207 |
| 3,452,307 | 6/1969 | Barnard | 335/207 X |
| 3,472,986 | 10/1969 | Stallman | 200/313 |
| 3,639,869 | 2/1972 | Pedersen | 335/207 |
| 3,815,066 | 6/1974 | Vinal | 335/207 X |

*Primary Examiner*—James R. Scott
*Attorney, Agent, or Firm*—Neuman, Williams, Anderson & Olson

[57] ABSTRACT

A switch operator is provided which has an elongated element magnetically attracted to yieldably assume predetermined static or neutral position within an elongated passage formed in a stationary base. The element is adapted to be manually moved longitudinally in either of two directions from the static position thereby causing the switch to be actuated. Upon the element being released it will automatically return to its static position.

13 Claims, 5 Drawing Figures

SWITCH OPERATOR

BACKGROUND OF THE INVENTION

Illuminated and non-illuminated heavy duty oil tight push-pull switch operators are well known and are frequently designed as illustrated in U.S. Pat. No. 3,472,986 which was granted to James E. Stallman on Oct. 14, 1969, to be used with other modular components to provide a large number of combinations of switching capabilities. One form of an operator, as illustrated in the Stallman patent, known as a momentary push-pull operator, included a spring-biased cam structure which normally maintained a plunger in a neutral position and permitted the plunger to be either pushed or pulled from the neutral position to selectively actuate switches that are mounted at the rear of the operator. While the structure therein disclosed provided satisfactory service, objections were made to its use because of the lack of detent action particularly if the stem thereof required only limited travel from its neutral position to effect actuation of the switch.

Operators of the type hereinafter disclosed are frequently used in machine shops and the like where minute iron particles are present. Therefore designers of industrial control switching devices usually have avoided including permanent magnets in devices because of the propensity of permanent magnets to attract the iron filings which would cause the devices embodying permanent magnets to have a whiskered appearance within a short time after being placed in service.

SUMMARY OF THE INVENTION

Thus, it is an object of this invention to provide a switch operator which has effective detent action even though the operator has limited travel from a static or neutral position.

It is a further object of this invention to provide a switch operator which is capable of being used with a variety of different types and sizes of switches.

It is a still further object of the invention to provide a switch operator wherein minimum dynamic friction is encountered when the operator is being manually manipulated.

It is a still further object of the invention to provide a switch operator which has a low overall height and a prolonged mechanical life, is highly resistant to the contaminates normally encountered in an industrial environment, and prevents the escape of the magnetic field when the latter is in neutral or static position.

Further and additional objects will appear from the description, accompanying drawings and appended claims.

In accordance with one embodiment of the invention, a switch operator is provided for actuating one or more fixedly mounted switches. The operator includes a stationary base having an elongated open-ended passage formed therein and extending from the exterior side to the interior side of the base. Mounted for longitudinal movement within the base passage is an elongated element which has an outer end protruding from the exterior side of the base and an inner end protruding from the interior side of the base. The element is adapted to normally assume a predetermined static or neutral position within the base passage. Disposed within the passage are magnetically attracted components. A first of the components encompasses and is affixed to the exterior of the element and moves therewith. A pair of second components is provided with the second components disposed on opposite sides of the first component. Each second component encompasses the exterior of the element and both of the second components are in simultaneous magnetic contact with the first component only when the element is disposed in its predetermined static position. When the element is manually moved from the static position, one of the second components will move with the first component while the magnetic contact between the other second component and the first component will be broken and effect a detent action. When the manual force is released from the element, the latter will automatically return to its static position.

DESCRIPTION

For a more complete understanding of the invention, reference should be made to the drawings wherein.

Figure 3:
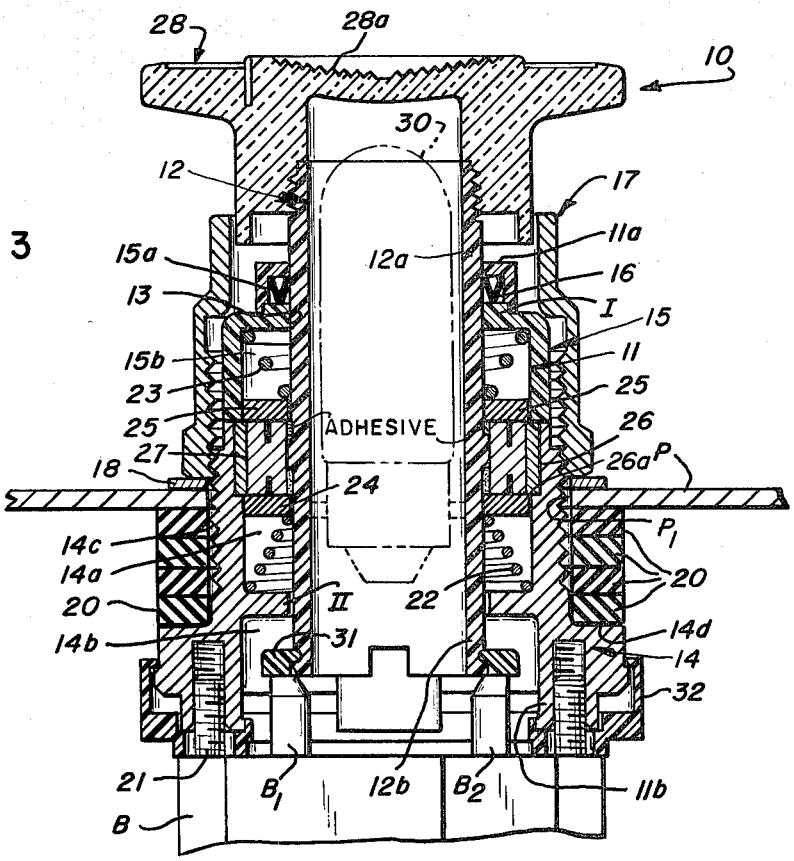
FIG. 3 is a sectional view taken along line 3—3 of FIG. 2 and showing the switch operator assembled with the panel and a switch, and showing in phantom lines a light source within the operator.
Figure 3A:
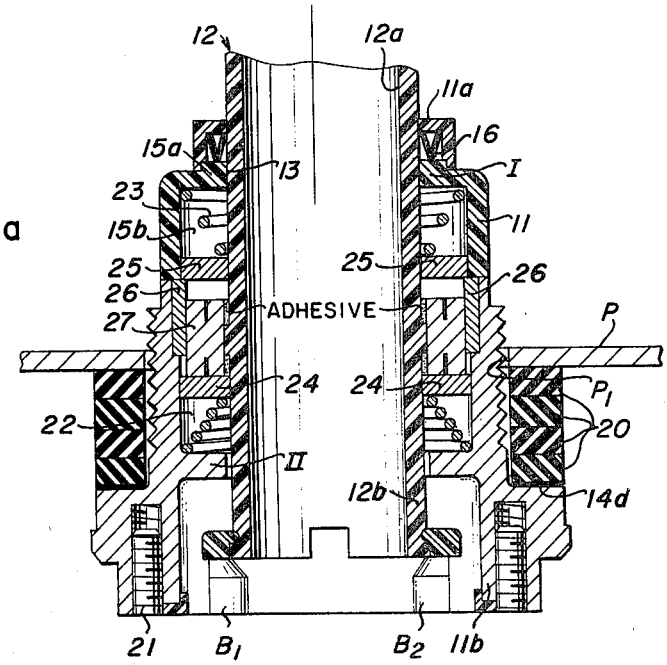

FIG. 3*a* is a fragmentary sectional view, similar to FIG. 3, but showing the elongated element of the operator in a depressed position.

Figure 4:
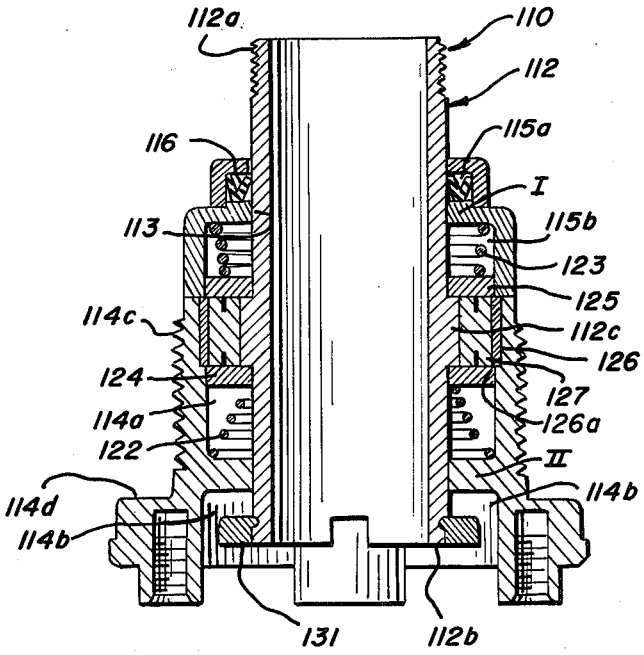

FIG. 4 is a fragmentary sectional view similar to FIG. 3 of a modified form of improved switch operator.

Figure 1:
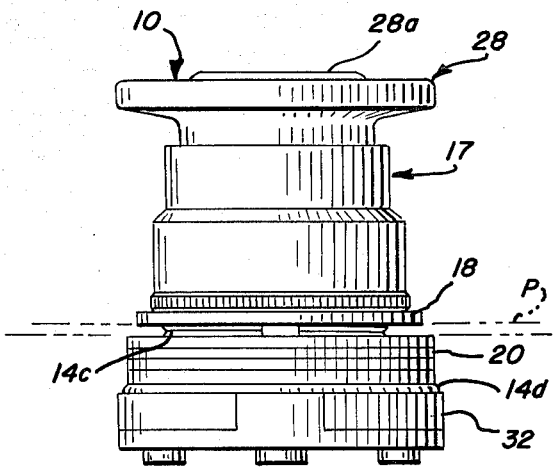
FIG. 1 is a side elevational view of one form of the improved switch operator and showing in phantom lines a panel to which it is attached.
Figure 2:
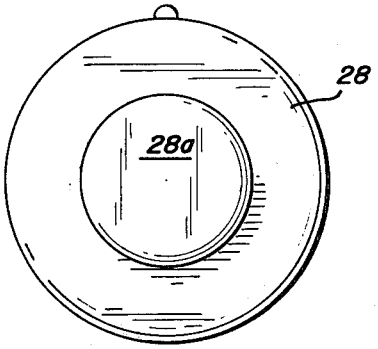
FIG. 2 is a top plan view of the switch operator of FIG. 1.

Referring now to the drawings and more particularly to FIGS. 1–3, a preferred form of an improved switch operator 10 is shown which is adapted to be used, for example, in an industrial type of motor control circuit. The operator 10 is normally mounted in an opening $P_1$ in a panel P behind which is located one or more contact blocks B comprising a part of one or more switches. The operator 10 includes a base 11 which is of composite construction, and an elongated stem or element 12 which is mounted for longitudinal movement within an open-ended passage 13 formed within the base 11. The base 11 has an exterior side 11*a* disposed on the exposed side of panel P and from which the outer end 12*a* of the element 12 protrudes, and an interior side 11*b* disposed on the concealed side of said panel. Protruding longitudinally from the interior side 11*b* of the base is the inner end 12*b* of the element 12. The inner end 12*b* of the element is shown disposed adjacent the ends of the linearly movable plungers $B_1$ and $B_2$ which form parts of the switches and are adapted to normally assume upwardly projecting positions relative to the contact blocks B, as seen in FIG. 3. The number of switches, contact blocks and plungers may vary from that shown if desired.

A typical installation wherein the switch operator 10 may be used in a motor control circuit would be to arrange the electrical connections to the switches, actuated by the switch operator, so that a motor will start when the upper end 12*a* of the element 12 is either manually pulled or depressed relative to the base 11, see FIG. 3*a*, and will continue to operate until the element 12 is manually manipulated in the opposite direction relative to the base. When not manually manipulated, the element 12 will normally assume a static (or neutral) position relative to the base passage 13; the element in its static position is shown in FIG. 3. The element is magnetically retained in its static position in a manner to be hereinafter described.

The base 11, as aforenoted, is preferably of composite construction so as to facilitate initial assembly of the operator and comprises a lower section 14 and an upper section 15. The adjacent ends of the sections are secured to one another in abutting relation by ultrasonic welding or the like. The upper end of section 15 is offset inwardly so as to provide an upper bearing I for the element 12. A cavity 15*a* is formed in the upper bearing to accommodate an oil seal 16. Disposed beneath the upper bearing is an enlarged cavity 15*b* which has an open lower end. The upper bearing and cavity 15*b* form segments of the base passage 13. Cavities 15*a* and *b* are separated from one another by a portion of the upper bearing.

The lower section 14 of the base is provided with a first cavity 14*a* having an open upper end which communicates with the open end of cavity 15*b* formed in section 15. Preferably both cavities 14*a* and 15*b* have substantially the same radial dimensions. The lower end of cavity 14*a* is closed by a lower bearing II. Beneath bearing II is a second cavity 14*b* having an open lower end which is adapted to accommodate the lower end 12*b* of element 12 and the switch plungers $B_1$ and $B_2$.

Bearings I and II serve to guide the longitudinal movement of the element 12 relative to the base 11.

A portion 14*c* of the base section is externally threaded and extends through the opening $P_1$ formed in panel P. The portion 14*c* is adapted to threadably receive an exposed ring nut 17. Disposed between the lower end 17*a* of the ring nut and the exposed side of the panel is a suitable washer 18.

Beneath the threaded portion 14*c* of section 14 is formed an outwardly projecting shoulder 14*d*. Positioned between shoulder 14*d* and the concealed side of panel P are a plurality of oil seal washers 20. Thus, as the ring nut 17 is drawn up tight on the threaded portion 14*c* of the base, the washer 18, the portion of the panel P circumjacent the opening $P_1$ and the plurality of washers 20 will be clamped between the nut 17 and the base shoulder 14*d* whereupon the base 11 will assume a stationary position.

Internally threaded openings 14*e* may be formed on the underside of base section 14 to receive mounting screws 21 for attaching the contact blocks B to the base section 14.

Disposed within cavities 14*a* and 15*b*, respectively, are return springs 22 and 23 which are preferably of the conical type. The large end of spring 22 engages the upper surface of bearing II and the corresponding large end of spring 23 engages the under surface of bearing I. The small ends of the springs 22 and 23 resiliently engage metallic rings (sometimes referred to as shorting rings) 24 and 25, respectively, so that each ring is biased to engage a corresponding end of a fixedly mounted spacer sleeve 26 and the end faces of a permanent magnet 27 carried by the element 12 when the latter is in its static position. Rings 24 and 25 slidably encompass longitudinally spaced exterior portions of the element 12. The rings 24 and 25 are capable of sliding longitudinally within the respective cavities 14*a* and 15*b*.

Permanent magnet 27 is located between rings 24 and 25 and in the FIG. 3 embodiment, is secured by an adhesive or the like to the exterior of the element 12 at approximately its mid-length so that the element and magnet 27 move longitudinally as a unit within the base passage. The outside diameter of the magnet 27 is less than the outside diameter of rings 24 and 25 so as to accommodate the inward projection 26*a* of the spacer sleeve 26 into the passage. As aforementioned, the spacer sleeve projection 26*a* serves as a stop for each ring 24 or 25. In addition, the sleeve is formed of a material which is non-responsive to the magnetic field.

Each of the end faces of magnet 27 in one form of the operator is provided with north and south poles and, thus, when the end face is engaged by the corresponding ring, the magnetic flux between the poles will be shunted by the contacting ring.

Preferably the axial dimension of the sleeve 26 and the magnet 27 are the same, so that when the element 12 is at its predetermined static position (FIG. 3), the magnet will be simultaneously engaged by the shorting rings 24 and 25 and be completely surrounded by the sleeve and thereby confine the magnetic field to between the rings 24 and 25 and the magnet 27. The principal function of the magnetic components 24, 25 and 27 is to yieldably retain the element 12 in its normal static position and provide a detent action when the element 12 is moved from its neutral position. The conical springs 22 and 23 supply the principal force in returning the element from either its fully extended or depressed positions to the static position.

Element 12 has a cap piece 28 mounted on its outer end 12*a*. The cap piece facilitates manual pulling of the element to its fully extended position. The central portion 28*a* of the cap piece may be translucent if desired, when an illuminating means, such as a bulb 30, is carried within the interior of the element, see FIG. 3. The bulb and its energizing circuit are well known in the art and do not per se constitute the invention herein disclosed and claimed. The bulb can be made to illuminate when the element is in either its neutral (static) position or when it is in its fully extended and depressed positions.

To limit the extent to which the element 12 can be manually pulled from its static position, a lock ring 31 is affixed to the inner end 12*b* of the element and said ring will abut the underside of bearing II. The lock ring 31 is of such a size and shape that it will engage the plungers $B_1$ and $B_2$ when the element is depressed.

It is customary for the switch plungers $B_1$ and $B_2$ to be biased to assume an extended position; however, when the element 12 is in its neutral or static position, the plungers are restrained by element 12 to assume their fully extended positions until the element 12 is manually pulled from its neutral position. Thus, the bias of spring 23 and the magnetic pull of magnet 27 and ring 24 are greater than the bias exerted on the plungers $B_1$ and $B_2$.

When the interior side 11*b* of the base is to be connected to the contact blocks B, an adapter piece 32 is utilized to locate or align the blocks B behind the operator 10. The seal 16 and the seal rings 20 serve to prevent contamination within the interior of the operator.

A modified version of the switch operator 110 is shown in FIG. 4. Numerous parts and components of the operator 110 are the same or similar to those of the operator 10 and have been identified by the same number except in a 100 series. The principal structural difference between operators 10 and 110 is that in operator 110 the magnet 127 remains in a fixed position within the base passage 113 and the element 112 moves relative thereto when manually moved from the static position shown in FIG. 4. At approximately its mid-length, the element 112 is provided with an external collar 112*c* which has an axial length approximating that of the fixed magnet 127. The end faces of the collar 112*c* are in contact with rings 124 and 125, when the element is disposed in its static position. By reason of the axial dimension of the collar 112*c*, no lost motion occurs between the element and one of the rings when the element is manually manipulated. The magnet 127 may be held in a fixed position with an inwardly projection portion 126*a* of the spacer sleeve 126 by a suitable adhesive or the like.

Thus, it will be noted that an improved switch operator has been provided which has a prolonged mechanical life, is highly resistant to contaminates, and prevents the escape of a magnetic field when the element is in its static position. Furthermore, in the improved switch operator the magnetic field required is reduced to a minimum because at least one of the shorting rings 24–25 or 124–125 is always in magnetic contact with the magnet 27 or 127 regardless of the relative position of the element within the base passage. The dynamic friction is reduced to a minimum in the improved switch operator, thereby facilitating manual manipulation thereof and also simplifying the mechanical construction of the operator.

The size and configuration of the various parts comprising the improved switch operator may be varied from that shown without departing from the scope of the invention.

I claim:

1. A switch operator for use in actuating a fixedly mounted switch, said operator comprising a stationary base having an elongated open-ended passage formed therein and extending from an exterior side of the base to an interior side thereof, said base interior side being positionable adjacent the switch; an elongated element mounted for longitudinal movement within said passage and having an outer end adjacent the base exterior side and an inner end adjacent the base interior side, said element being biased to assume a predetermined static position within said passage, said element inner end being adapted to effect actuation of the switch when said element moves in one direction from said static position to a first terminal position upon a predetermined external force being applied to the element outer end; and magnetically attracted components disposed within said passage, at least one of said components normally assuming a predetermined rest position within said passage and being engaged by said element and yieldably resisting movement thereof in said one direction and automatically returning said element to said static position upon the external force being removed from the element outer end, said components being in magnetic contact with one another to provide a shunt for the magnet flux between the components when said element is disposed at said static position and said one component is disposed at said rest position and oppose movement of the element with a detent-like action when said element is moved from the static position.

2. The switch operator of claim 1 wherein the element is capable of being moved in opposite directions from said static position and the one component is mounted independently of the element and when said one component is at said rest position resiliently engaging an immovable stop means mounted on said base and protruding into said passage and being spaced from the ends thereof.

3. The switch operator of claim 2 wherein a second component of the magnetically attracted components is secured to said element and is movable therewith.

4. The switch operator of claim 3 wherein the second component comprises a permanent magnet encompassing a portion of said element exterior and said one component comprising a magnetically responsive annular member encompassing the exterior of said element and mounted for movement independently of said element, said member being disposed longitudinally of said magnet.

5. The switch operator of claim 2 wherein said stop means includes a sleeve formed of material substantially nonresponsive to a magnetic field, said sleeve encompassing a second component of the magnetically attracted components when said element assumes said static position, one end of said sleeve abutting said one component when the latter is in said rest position.

6. The switch operator of claim 5 wherein the second component is fixedly mounted on the exterior of said element and is movable therewith as a unit.

7. The switch operator of claim 6 wherein said second component comprises a permanent magnet; said magnet and said sleeve having substantially the same axial dimensions.

8. A switch operator for use in actuating a fixedly mounted switch, said operator comprising a stationary base having an elongated open-ended passage formed therein and extending from an exterior side of the base to an interior side thereof, said base interior side being positionable adjacent the switch; an elongated element mounted for longitudinal movement within said passage and having an outer end adjacent the base exterior side and an inner end adjacent the base interior side, said element being biased to assume a predetermined static position within said passage, the outer end of said element being adapted to have external forces applied thereto to effect movement of said element from said static position, said element inner end being adapted to engage an actuator of the switch to effect change of position thereof dependent upon the direction of movement of said element from said static position; magnetically attracted components disposed within said passage and cooperating with one another to yieldably retain said element in said static position and to provide a detent-like action when said element is moved from said static position, a pair of first components mounted within said passage for movement independently of one another and with the element depending upon the direction of movement thereof from said static position, said first components being disposed on opposite sides of a second component and simultaneously in magnetic contact therewith only when said element is disposed in said static position.

9. The switch operator of claim 8 including a sleeve formed of non-magnetic responsive material fixedly mounted within said base passage and in encompassing relation with the second component when the element is disposed in said static position.

10. The switch operator of claim 9 wherein the second component is affixed to and movable with said element, and the sleeve has portions thereof protruding into said base passage, said portions being simultaneously resiliently engaged by the first components when said element is disposed at said static position;

each first component being movable independently of the other by said second component depending upon the direction of movement of said element from said static position.

11. The switch operator of claim 9 wherein the second component is fixedly mounted within said base passage and said element is movable independently thereof, said element being provided with an exterior protuberance adapted to abut one first component independently of the other upon said element moving in one direction from said static position and effecting disengagement of said one component from said fixedly mounted second component.

12. The switch operator of claim 8 wherein the outer end of said element is self-illuminating when said element assumes a predetermined relative position within said base passage.

13. The switch operator of claim 8 wherein each first component is biased independently of the other in a direction towards one another.

* * * * *